US005582695A

United States Patent [19]

Olsen

[11] Patent Number: 5,582,695

[45] Date of Patent: Dec. 10, 1996

[54] STRUCTURAL PARTS FOR ELECTROLYTIC REDUCTION CELLS FOR ALUMINUM

[75] Inventor: Odd Olsen, Vanse, Norway

[73] Assignee: Elkem Aluminium ANS, Norway

[21] Appl. No.: 448,493

[22] PCT Filed: Nov. 25, 1993

[86] PCT No.: PCT/NO93/00178

§ 371 Date: Jul. 17, 1995

§ 102(e) Date: Jul. 17, 1995

[87] PCT Pub. No.: WO94/12693

PCT Pub. Date: Jun. 9, 1994

[30] Foreign Application Priority Data

Nov. 30, 1992 [NO] Norway ..... 924610

[51] Int. Cl.[6] ..... C04B 7/32; C04B 14/04; C04B 14/02; C04B 14/30

[52] U.S. Cl. ..... 204/279; 106/737; 106/688; 106/801; 106/819; 106/692; 501/124; 428/206; 428/688; 428/689; 204/290 R; 204/280; 204/291

[58] Field of Search ..... 106/692, 694, 106/737, 685, 638, 688, 801, 819; 501/124; 204/279, 290 R, 280, 291; 428/688, 689, 193, 206

[56] References Cited

U.S. PATENT DOCUMENTS

| | | | |
|---|---|---|---|
| 2,511,724 | 6/1950 | Lobaugh | 106/692 |
| 3,060,043 | 10/1962 | Renkey | 501/124 |
| 3,802,894 | 4/1974 | Prost et al. | 501/124 |
| 4,111,711 | 9/1978 | Kiehl et al. | 106/692 |
| 4,174,972 | 11/1979 | Drouzy et al. | 501/124 |
| 4,239,606 | 12/1980 | Dawless et al. | 204/67 |
| 4,246,035 | 1/1981 | Maczura et al. | 106/692 |
| 4,619,750 | 10/1986 | Bessard | 204/243 R |
| 4,680,279 | 7/1987 | Kleeh | 501/125 |
| 4,787,965 | 11/1988 | Audras et al. | 106/692 |
| 4,943,544 | 7/1990 | McGarry et al. | 106/692 |
| 5,135,576 | 8/1992 | Johansen et al. | 106/638 |

FOREIGN PATENT DOCUMENTS

| | | |
|---|---|---|
| 163298 | 2/1992 | Denmark . |
| 4128963 | 3/1993 | Germany . |
| 140632 | 10/1979 | Norway . |
| 171309 | 11/1992 | Norway . |

OTHER PUBLICATIONS

Edwards, Leslie C. et al., "Evaluation of a Bauxite Low Cement Castable in Aluminium Smelting Applications", Light Metals 1992 (no month).
Warrendale, PA: The Minerals, Metals & Materials Society, 1991, pp. 407–412.

*Primary Examiner*—Mark L. Bell
*Assistant Examiner*—Michael Marcheschi
*Attorney, Agent, or Firm*—Lucas & Just

[57] ABSTRACT

The structural part is used in an electolytic cell for production of aluminum and comes into contact with the gas atmosphere in the electrolytic reduction cell. The structural part is made completely from, or is a metal part which is coated with, a concrete composition of 15–30% by weight of a hydraulic cement, 5–10% by weight of microsilica and 65–85% by weight of a refractory filler material.

15 Claims, 2 Drawing Sheets

STRUCTURAL PARTS FOR ELECTROLYTIC REDUCTION CELLS FOR ALUMINUM

This is an application under 35 USC 371 of International Application No. PCT/NO93/00178 filed Nov. 25, 1993.

The present invention relates to structural parts for electrolytic reduction cells for aluminum, which parks are intended to be in contact with the gas atmosphere in the cell during operation of the cells.

TECHNOLOGICAL BACKGROUND

Electrolytic cells or furnaces for production of aluminum according to the Hall-Heroult method, comprise a generally rectangular, low, flat shell with refractory material and carbon blocks in its sides and bottom. The carbon blocks constitute a vessel for the produced aluminum and for the molten electrolyte. The carbon blocks in the bottom of the vessel are equipped with steel bars for electric coupling of the bus bars for the electric current. The bottom carbon blocks thus form the cathode for the electrolytic cell.

The molten electrolyte, which has a lower density than molten aluminium, consists of molten cryolite, certain inorganic salts, such as for example, aluminum fluoride and calcium fluoride, and dissolved aluminum oxide. Aluminum oxide is consumed during the electrolysis and aluminum oxide therefore has to be added to the electrolyte quite frequently. During operation of the electrolytic cells corrosive fluorine- and sulphur-containing gases are produced.

In electrolytic cells for production of aluminum equipped with self-baking anodes or Søderberg anodes, each cell usually is equipped with one substantially rectangular anode. The Søderberg anode consists of a permanent outer casing made from cast iron or steel, which casing surrounds the self-baking carbon anode. Unbaked carbonaceous electrode paste is charged at the top of the anode and this unbaked electrode paste is baked into a solid carbon anode due to the heat which evolves during the supply of electric operating current to the anode and the heat from the molten bath. A major feature of the Søderberg anode is thus that the baked solid anode moves relatively to the permanent anode casing.

In order to collect gases which evolve during the electrolytic reduction process, Søderberg anodes are equipped with so-called gas shirts which run from the anode casing and outwardly and downwardly against the electrolyte where a seal is formed against the crust which forms on the top of the molten electrolyte. The gases which evolve are collected under the gas shirts, sucked off and are burned outside the electrolytic cell. The gas shirts are normally made from east iron which is reasonably resistant against the atmosphere and the temperature in the electrolytic cell. Even if cast iron is reasonably resistant against the gases, the gas shirts have to be replaced at intervals. Cast iron has further a low resistance against the molten electrolyte and by contact with molten electrolyte, for example by splashing, the cast iron erodes very quickly.

Recently, for environmental reasons, it has been proposed to replace the gas shirts with cover plates that run from the anode casing and to the sidewall of the furnace. This solution is disclosed in Norwegian patent no. 1628868. The electrolytic cells are thereby completely closed. The cover plates have been made from steel, but it has been found that even though the distance from the molten electrolyte to the cover plates is substantial longer than the distance from the molten electrolyte to the gas shirts, the steel in the cover plates is eroded rapidly and must therefore be replaced with short intervals.

Further the lower ends of the anode casing made from cast iron or steel is also eroded and must be replaced. The erosion of steel and cast iron parts in the electrolytic cells also gives an increase in the iron content in the produced aluminum.

The CO-containing gas which is produced in electrolytic reduction cells for production of aluminum is collected and combusted by air in burners arranged in gas collection pipes in the cells. These burners which are made from east iron have a short life-time due to erosion and must be replaced frequently.

It has been tried to replace the above mentioned structural parts of electrolytic reduction cells for production of aluminum by other materials such as different kinds of ceramic materials and refractory castables. Thus in Norwegian patent No. 140632 use of a calcium aluminate bonded layered alumina is mentioned as a lining under a steel cover for an electrolytic reduction cell for production of aluminum. In Light Metals, 1992 page 407 to 412 use of a high alumina cement castable is described which shows resistance against molten cryolitt. This castable contains over 90% by weight of fine bauxite. Thus the cement content is very low. Moisture is added in an amount of 3.8–4.0% during mixing of the castable and vibration during casting is essential to promote flowability and maximize density. Thus this cement castable can, due to its low flow, not be used for casting complex shapes. Further there is no indication in the article that the castable is resistant against the gas atmosphere in an electrolytic reduction cell for production of aluminum. Thus cast iron and steel are still the dominant material used for structural parts intended to be in contact with the gas atmosphere in electrolytic reduction cells for production of aluminum.

Thus there is a need for a material which is resistant against the atmosphere that exist in electrolytic cells for production of aluminum and which can be used for the above-mentioned structural parts.

Disclosure of inventions

The inventors have found a special type of concrete material which shows to be surprisingly resistant both against molten electrolyte and against the gas atmosphere in electrolytic cells for production of aluminum.

Thus the present invention relates to structural parts for electrolytic cells for production of aluminum, which parts are intended to be in contact with the gas atmosphere during operation of the electrolytic cells, the invention being characterized in that parts at least partly are made from concrete comprising 15–30by weight hydraulic cement, 5–10% by weight of microsilica and 65–80% by weight of a refractory filler material.

Preferably the cement content in the concrete is between 20–25% by weight and the weight of refractory filler material is preferably between 70 and 75% by weight.

According to a preferred embodiment calcium aluminate cement is used as hydraulic cement, but MgO can also be used. The refractory filler material used is preferably $Al_2O_3$.

The concrete mix is preferably made using a ratio between water and cement+microsilica between 0.15 and 0.30, and preferably between 0.17 and 0.25.

Microsilica is amorphous silica particles collected from the off-gas from electrothermic smelting furnaces for production of ferrosilicon or silicon. It is also possible to obtain microsilica as a main product from these furnaces by adjustment of the operating parameters. Amorphous silica of this kind can also be produced synthetically without reduction or reoxidation. Finally a microsilica generator can be used for production of fine particulate silica or silica can be produced by precipitation from aqueous solutions.

Microsilica may contain 60–100% by weight of $SiO_2$ and has a density between 2.00 and 2.40 g/cm$^3$ and a specific surface area of 15–30 m$^2$/g. The particles are of a substantially spherical shape and have a particle size substantially about 1 μm. Variation in these values are possible. The microsilica may have a lower $SiO_2$ content and the particle size distribution can be adjusted be removing coarse particles.

The structural parts according to the present invention may as mentioned be made completely from the refractory concrete. Alternatively, the structural pans may be made from steel which at least on the side facing the inside of the electrolytic cell has a layer of the refractory concrete.

The structural parts according to the present invention are normally made by pouring the concrete mixture into moulds and thereafter allowing the concrete to cure. Alternatively the structural parts are made by building up a layer on steel plates.

It has surprisingly been found that structural parts according to the present invention which wholly or partly consist of the concrete have an extremely good resistance against the environment in an electrolytic cell for production of aluminum. Thus cover plates according to the present invention have been in use in electrolytic reduction cells for production of aluminum for more than one year. When the cover plates were removed for inspection, there was no sign of wear on the cover plates. Further, no signs of gas penetration were found in the concrete.

DETAILED DESCRIPTION OF THE DRAWINGS

Figure 1:
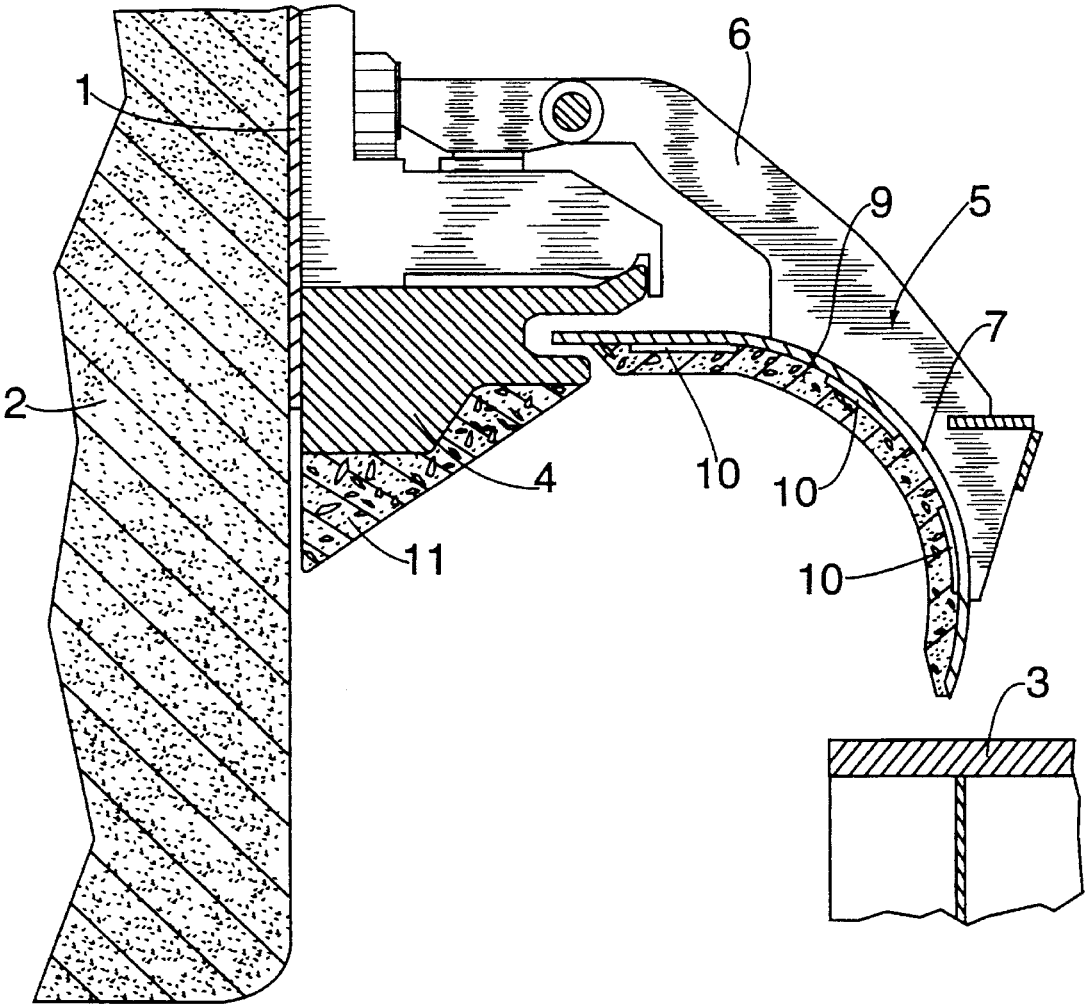
Figure 2:
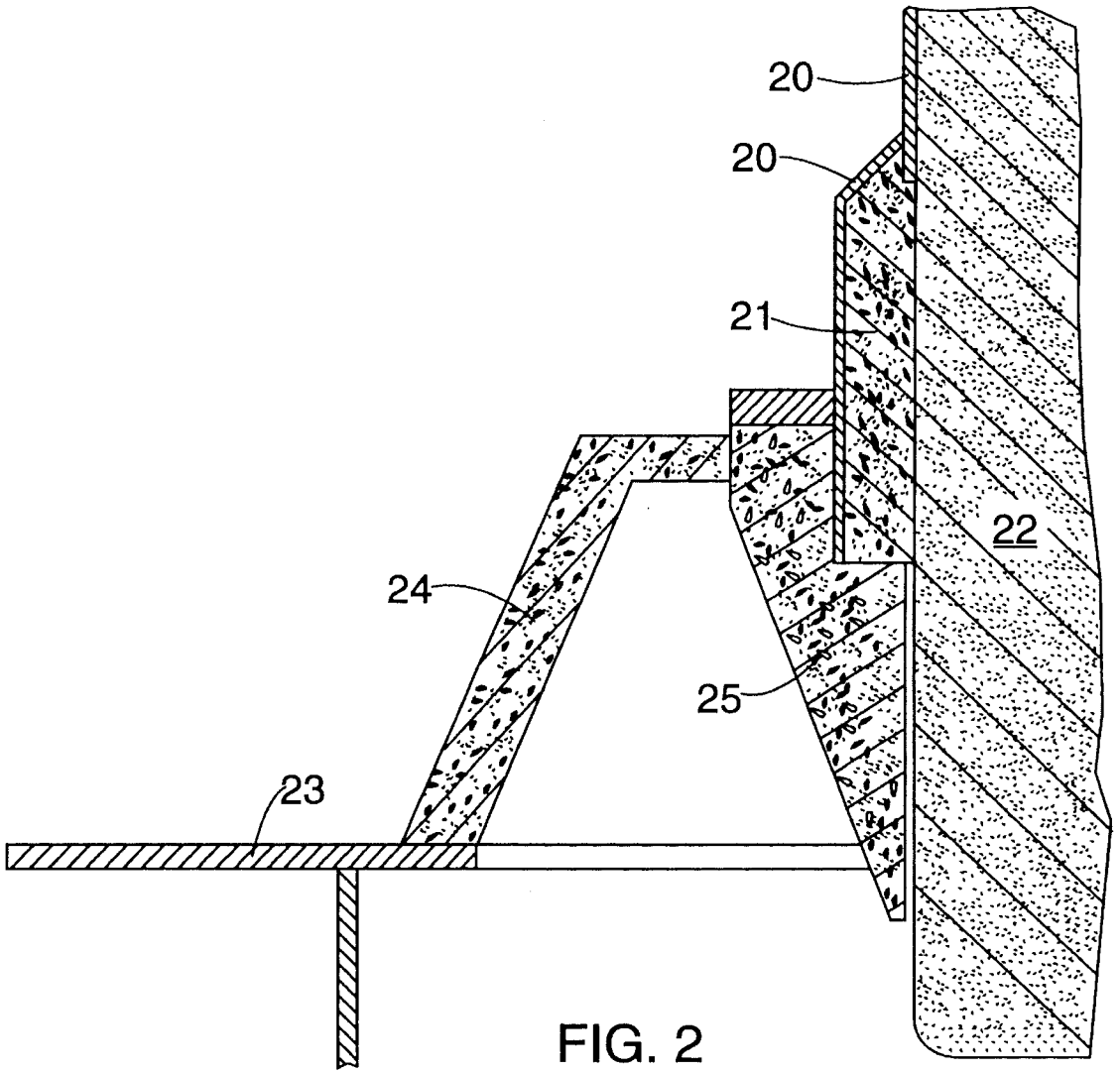

Some embodiments of the present invention will now be further described with reference to the accompanying drawings, wherein FIG. 1 shows a vertical cut through a cover plate for an electrolytic reduction cell for production of aluminum according to the present invention, and where FIG. 2 shows a vertical cut through a cover plate and an anode casing for an electrolytic reduction cell for production of aluminum where the cover plate and the lower part of the anode casing are made from concrete according to the present invention.

DETAILED DESCRIPTION OF THE INVENTION

On FIG. 1 there is shown an anode casing 1 made from steel or cast iron for an electrolytic cell for production of aluminum. The anode is indicated by reference numeral 2. The sidewall of the cell is shown by reference numeral 3. On the anode casing 1 there is arranged a horizontal east iron flange 4 on which cover plates 5 are mounted. The cover plates 5 are liftably arranged by means of an arm 6 connected to the anode casing 1. Alternatively the cover plate 5 can be lifted or adjusted by means of a vehicle. The cover plate 5 is made from a steel plate 7. On the underside of the plate 7 the cover plate 5 has a concrete layer 9 consisting of 23% by weight of calcium aluminate cement, 6% by weight of microsilica and 71% by weight of aluminum oxide. The water to cement+microsilica ratio when mixing the concrete was 0.17. In order to ensure that the concrete layer 9 is affixed to the plate 7, iron reinforcements 10 are affixed to the plate 7. Also the underside of the flange 4 is covered by a layer 11 made from the same concrete as used in the layer 9 of the cover plate 5. The cover plate 5 and the flange 4 having this layer of concrete have been in use for more than two years in an electrolytic cell for production of aluminum and show no sign of wear or damage.

On FIG. 2 there is shown an anode casing 20 made from steel or cast iron where the lower part 21 of the anode casing is made from concrete having the same composition as in the parts described in connection with FIG. 1. The anode itself is indicated by reference numeral 22. Between the sidewall 23 and the anode casing 20 there is arranged a cover 24. The cover 24 is completely made from the same type of concrete that was used for the structural parts described in connection with FIG. 1. Finally, the anode casing 20 in the embodiment shown in FIG. 2 is equipped with a flange 25 that extends downwards against the molten electrolyte and thereby protects the anode 22 below the anode casing 21. Also the flange 25 is made from the same type of cement that was used for the structural parts shown in FIG. 1.

All parts in the electrolytic cell that are exposed to the gas atmosphere in the cell are thus made from structural parts according to the present invention. After two years of use, no wear or damage could be found on the structural parts according to the present invention.

I claim:

1. In an electrolytic cell for production of aluminium, wherein said cell has sidewalls, an anode with an anode casing around said anode, and a cover that extends from the anode casing to the sidewalls to provide a seal between the anode casing and the sidewalls, said electrolytic cell having a gas atmosphere and said anode casing and said cover being in contact with the gas atmosphere during operation of the electrolytic cell, the improvement comprising a concrete coating on said cover that is in contact with the gas atmosphere when said cell is in operation, said concrete coating being made from a concrete composition comprising 15–30% by weight hydraulic cement, 5–10% by weight of microsilica and 65–80% by weight of a refractory filler material.

2. The cell according to claim 1, wherein the hydraulic cement is calcium aluminate cement.

3. The cell according to claim 1, wherein the hydraulic cement is MgO.

4. The cell according to claim 1 wherein the refractory filler material is $Al_2O_3$.

5. The cell according to claim 1, wherein the concrete composition comprises 20–25% by weight of hydraulic cement and 70–75% by weight of refractory material.

6. The cell of claim 1 wherein the improvement further comprises said anode casing that is in contact with the gas atmosphere having a concrete coating made from said concrete composition.

7. In an electrolytic cell for the production of aluminum wherein said cell has sidewalls, an anode with an anode casing around said anode, and a cover that extends from the anode casing to the sidewalls to provide a seal between the anode casing and the sidewalls, said electrolytic cell having a gas atmosphere and said anode casing and said cover being in contact with the gas atmosphere when said cell is in operation, the improvement comprising said cover that is in contact with the gas atmosphere when said cell is in operation being made from a concrete composition comprising 15–30% by weight hydraulic cement, 5–10% by weight microsilica and 65–80% by weight of a refractory filler material.

8. The cell of claim 7 wherein the improvement further comprises said anode casing that is in contact with the gas atmosphere having a concrete coating, said concrete coating made from said concrete composition.

9. The cell of claim 7 wherein the improvement further comprises all of said cover being made of concrete.

10. The cell of claim 7 wherein the hydraulic cement is selected from the group consisting of calcium aluminate and MgO.

11. The cell of claim 7 wherein the refractory filler material is $Al_2O_3$.

12. The cell of claim 7 wherein said concrete composition comprises 20–25% by weight hydraulic cement and 70–75% by weight refractory filler material.

13. The cell of claim 9 wherein the hydraulic cement is selected from the group consisting of calcium aluminate cement and MgO.

14. The cell of claim 9 wherein the refractory filler material is $Al_2O_3$.

15. The cell of claim 9 wherein said concrete composition comprises 20–25% by weight hydraulic cement and 70–75% by weight refractory filler material.

* * * * *